United States Patent [19]

Adams

[11] 4,240,368

[45] Dec. 23, 1980

[54] MOTORIZED DRIVE FOR A SEWING MACHINE INCLUDING BELT TENSIONING MEANS

[75] Inventor: Kenneth D. Adams, Madison, N.J.

[73] Assignee: The Singer Company, Stamford, Conn.

[21] Appl. No.: 130,792

[22] Filed: Mar. 17, 1980

[51] Int. Cl.[3] ..... D05B 69/02

[52] U.S. Cl. ..... 112/220; 474/86; 474/113

[58] Field of Search ..... 112/220, 221, 284, 217.1; 74/242.13 R, 242.13 A, 228, 242.15

[56] References Cited

U.S. PATENT DOCUMENTS

| | | | |
|---|---|---|---|
| 2,205,176 | 6/1940 | Sauer | 74/242.13 R |
| 2,838,020 | 6/1958 | Eriksson | 112/220 |
| 3,157,142 | 11/1964 | Birch et al. | 112/220 |
| 3,477,670 | 11/1969 | Sloyan | 74/242.13 R X |

*Primary Examiner*—Peter P. Nerbun

*Attorney, Agent, or Firm*—William V. Ebs; Robert E. Smith; Edward L. Bell

[57] ABSTRACT

A module including a frame which supports a motor, reduction gearing and a belt driving pulley is mounted in a sewing machine for position adjusting movements in one direction effective to set tension in a shaft timing belt, and position adjusting movements in another direction effective to set tension in a hook shaft timing belt.

10 Claims, 6 Drawing Figures

Fig.1
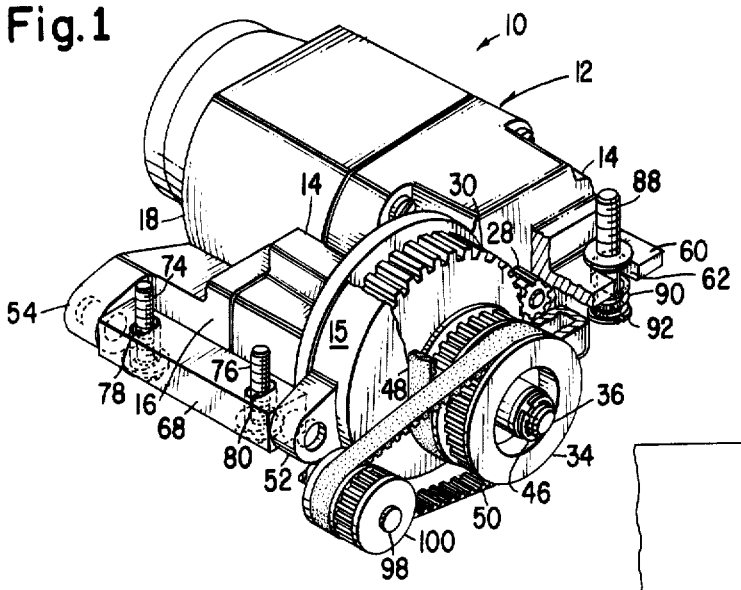
Fig.2
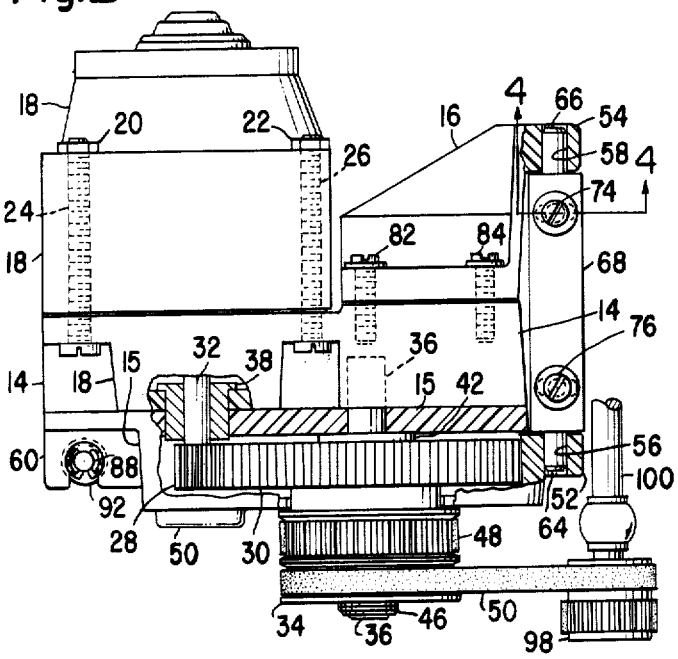
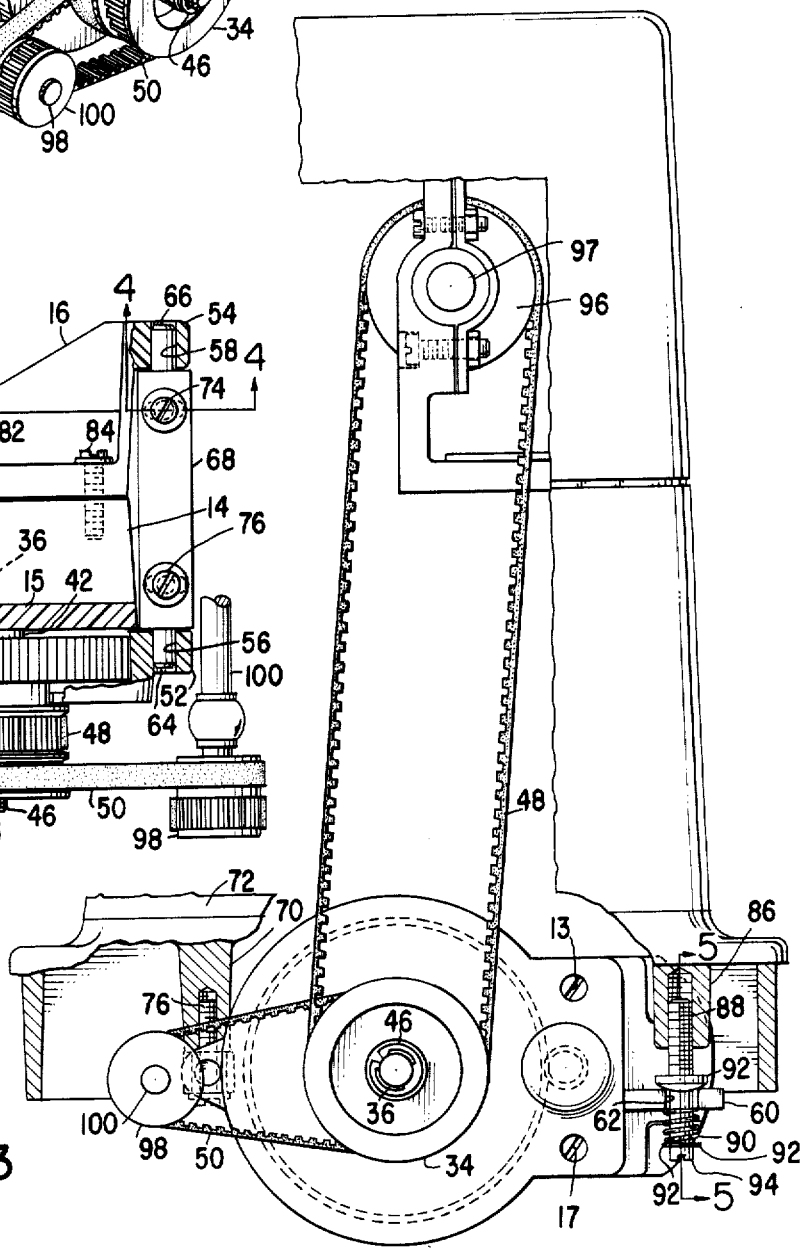
Fig.3

MOTORIZED DRIVE FOR A SEWING MACHINE INCLUDING BELT TENSIONING MEANS

BACKGROUND OF THE INVENTION

1. Field of the Invention

The invention relates to motorized drives for sewing machines, and in particular to motors in association with belts for use in driving the operating mechanism of sewing machines.

2. Description of the Prior Art

It is common practice to have a motor drive an arm shaft in the bracket arm of a sewing machine through a timing belt that runs over a small diameter pulley on the motor shaft and a larger diameter speed reducing pulley on the arm shaft; and further to have the arm shaft drive a hook shaft in the bed of the machine through another timing belt. It is also well known to have the motor in a frame which can be pivotally adjusted in the machine to tighten the belt between the motor and arm shaft, and to have the other belt run over one or more idlers which can be positionally adjusted to tighten such other belt. There are however, a number of disadvantages to the use of a motorized drive as described in a sewing machine.

Among the disadvantages of the described system is the need to provide separate belt tensioning means for each of two belts which must be adjusted to a desired degree of tightness. Disadvantages also arise from the use of idlers since they add to the cost of a system, generate heat and increase the inertia of the system. Furthermore, the described system is unsuited to the use of a high speed motor because the required speed reduction is not then obtainable at the arm shaft with a pulley of convenient size. A relatively low speed motor, which is therefor inefficient and a source of considerable heat, must be used. As a consequence the frame supporting the motor for pivotal movement in the machine must be fashioned from metal to conduct heat away from the motor rather than from a non-conducting, less expensive plastic material. In addition, the use of two rather long belts introduces lost motion into the system.

The said disadvantages are eliminated in accordance with the invention, with an improved modular motorized drive and novel means for mounting the drive in a sewing machine.

SUMMARY OF THE INVENTION

A modular drive for a sewing machine according to the invention includes a molded plastic frame, a motor which is affixed to the frame, speed reducing means in the form of meshing gears or a belt and pulley arrangement supported in the frame, and an output pulley which is rotatably supported in the frame. The output pulley is provided for the purpose of driving a belt extending therefrom in one direction to an arm shaft, and another belt extending from such pulley in a different direction to a hook shaft. The module is mounted in the frame of the sewing machine so that it may be positionally adjusted by a pivotal movement effective to set tension in one belt, and by a translational movement effective to set tension in the other belt.

DESCRIPTION OF THE DRAWINGS

FIG. 1 is a perspective view showing the module of the invention and means for mounting the module on the frame of a sewing machine;

FIG. 2 is a bottom plan view of the module shown mounted on a sewing machine frame;

FIG. 3 is an end view of the module shown on the sewing machine frame;

DESCRIPTION OF THE PREFERRED EMBODIMENTS OF THE INVENTION

Figure 4:
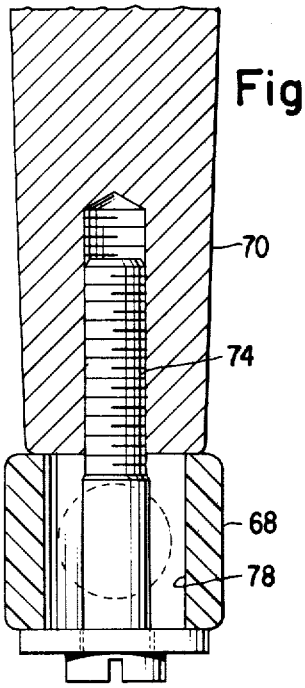
FIG. 4 is an enlarged sectional view taken on the plane of the line 4—4 of FIG. 2.
Figure 5:
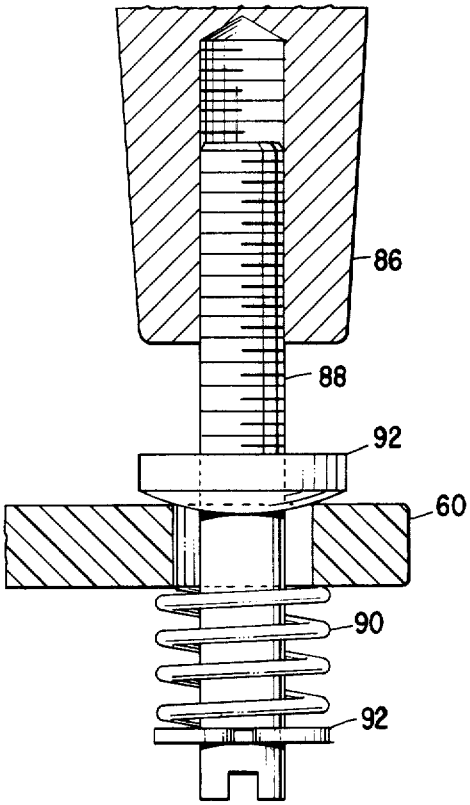
FIG. 5 is an enlarged sectional view taken on the plane of the line 5—5 of FIG. 3.

Referring to FIGS. 1 through 5 of the drawings, reference character 10 designates a modular motorized sewing machine drive constructed according to the invention. The module 10 includes a molded plastic fiberglass frame 12 having separable parts 14, 15 ad 16, a motor 18 which is secured to frame part 14 by nuts 20 and 22 on bolts 24 and 26 respectively, speed reducing meshing gears 28 and 30 of which the gear 28 is affixed to the output shaft 32 of the motor 18, and a toothed output pulley 34 which is rotatably supported on a shaft 36 secured in frame part 14 and includes the gear 30 as an integral part thereof. Frame part 15 is secured to frame part 14 as with screws 13 and 17 and encases the gears 28 and 30 as shown. A bearing 38 pressed into place in frame part 15 supports the output shaft 32 of motor 18. Shaft 36 is preferably secured to the frame part 14 by having it affixed in a mold for the part 14 at the time such part is formed. Output pulley 34 is longitudinally confined on shaft 36 between a common washer 42 and a resilient split washer 46 which snaps into a groove in the shaft.

The pulley is adapted to carry a toothed timing belt 48 for driving the arm shaft of a sewing machine and another toothed timing belt 50 for driving the hook shaft of the machine.

Frame parts 15 and 16 are formed with bosses 52 and 54 including cylindrical bores 56 and 58. The frame part 15 is also formed with a flange 60 including a slotted opening 62. The module is mounted in a sewing machine for pivotal adjusting movement as on studs 64 and 66 fashioned as integral end parts of a machine attached member 68 and received in the bores 56 and 58 respectively. As shown, the member 68 is straddled by the bosses 52 and 54, and is attached to a portion 70 of a sewing machine frame 72 by screws 74 and 76. Enlarged openings 78 and 80 in member 68 for the screws 74 and 76 respectively, allow for limited translational adjusting movements of the module when the screws are loose. The module 10 is mounted on the studs 64 and 66 with the frame parts 15 and 16 separated to permit the bore 56 in the boss 52 on frame part 15, and the bore 58 in the boss 54 on frame part 16 to receive studs 64 and 66, respectively, after which the frame parts 15 and 16 are assembled with screws 82 and 84. The frame 12 of the module 10 is then attached to a portion 86 of the screwing machine frame 72 with an adjusting screw 88 extending through opening 62 in flange 60 and threaded into the frame portion 86.

The module is biased in the sewing machine about the axis of studs 64 and 66 by a coil spring 90 to a position wherein the flange 60 on frame 12 is in engagement with a fixed collar 92 on screw 88, the spring 90 being compressed between flange 60 and a washer 92 which bears against the head 94 of screw 88. By turning the screw 88, the module 10 is pivotally moved on the studs 64 and 66 and may be thereby positionally adjusted to set tension in belt 48 extending above the module from output pulley 34 to engage a toothed pulley 96 affixed to the arm shaft 97 of the machine.

Tension in belt 50 which extends from output pulley 34 to the side of module 10 in a direction substantially perpendicular to belt 48 to engage a toothed pulley 98 on the hook shaft 100 of the machine may be set with the application of hand pressure to the module effective to translationally position the unit, providing the screws 74 and 76 have first been loosened to permit member 68 to slide on sewing machine frame portion 70. Once tension has been set in belt 50 the screws 74 and 76 are tightened to fix the position of member 68 on the machine frame portion 70. Opening 62 in flange 60 is dimensioned to allow for the translational positioning of the module.

Figure 6:
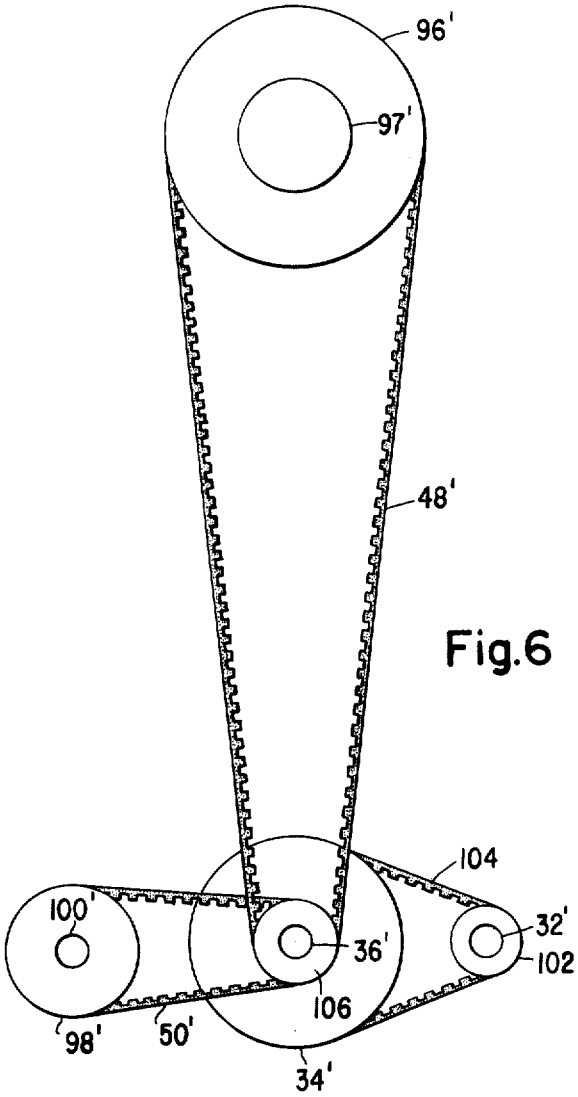
FIG. 6 is a schematic view showing a modified arrangement for the motorized drive of the invention.

Alternatives to the use of speed reducing gears 28 and 30 for driving output pulley 34 include a speed reducing belt drive such as shown in FIG. 6. In the arrangement of FIG. 6, wherein parts similar to those already shown in FIGS. 1 through 5 are designated with a like number having a prime mark (') added thereto, a toothed pulley 102 affixed to a motor shaft 32' carries a toothed timing belt 104 which drives an output pulley 34' on a shaft 36' at a reduced speed as compared to the speed of the motor shaft. A toothed hub 106 on the pulley 34' carries a timing belt 48' that drives a pulley 96' affixed to an arm shaft 97', and a timing belt 50' that drives a pulley 98' affixed to the hook shaft 100'. The timing belt 104 provided between the motor shaft 40' and output pulley 34' is less noisy than reduction gears, and serves to cushion vibrational movements of a modular construction mounted in a machine as hereinbefore described. In the arrangement of FIG. 6, only a portion of the reduction in speed between the motor shaft and each of the arm and hook shafts take place between the motor shaft 32' and pulley 34'. This permits the use of a larger diameter motor driven pulley 102 than otherwise possible, and so provides for the engagement of a substantial number of teeth on belt 104 with teeth of the pulley.

It is to be understood that the present disclosure relates to preferred embodiments of the invention which are for purposes of illustration only and are not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In combination, a sewing machine frame; a module including a frame, a motor attached to the frame of the module, speed reducing means which is driven by the motor, a shaft supported by the frame of the module, and a belt driving pulley which is rotatably supported on said shaft and is driven by the speed reducing means; belts on the pulley extending in different directions for driving mechanisms of the sewing machine; and means mounting the module on the frame of the machine for pivotal movement effective to set tension in one belt and translational movement effective to set tension in the other belt.

2. The combination of claim 1 wherein the speed reducing means is encased by the frame of the module.

3. The combination of claim 1 wherein the motor includes an output shaft which is rotatably supported in the frame of the machine.

4. The combination of claim 3 wherein the speed reducing means includes a gear on the output motor shaft in mesh with a gear on the belt driving pulley.

5. The combination of claim 4 wherein the gear on the belt driving pulley is encased by the frame of the module.

6. The combination of claim 4 wherein the gear on the motor shaft and gear on the belt driving pulley mesh within and are encased by the frame of the module.

7. The combination of claim 1 wherein the mounting means includes a translatable member which is securable to the frame of the sewing machine and about which the module can be pivoted.

8. The combination of claim 1 wherein the shaft which rotatably supports the belt driving pulley is positionally adjustable by the said pivotal and translational movements of the module in directions which are substantially mutually perpendicularly.

9. The combination of claim 1 wherein the frame of the module is a molded plastic part formed about the shaft which supports the belt driving pulley.

10. The combination of claim 1 wherein the speed reducing means includes a motor driven pulley and a belt which is driven thereby and which drives the pulley on the shaft supported in the module.

* * * * *